US011317774B2

(12) United States Patent
Yun et al.

(10) Patent No.: US 11,317,774 B2
(45) Date of Patent: May 3, 2022

(54) ROBOT CLEANER

(71) Applicant: Samsung Electronics Co., Ltd., Suwon-si (KR)

(72) Inventors: Min Ro Yun, Suwon-si (KR); Hyoun Soo Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 329 days.

(21) Appl. No.: 16/743,519

(22) Filed: Jan. 15, 2020

(65) Prior Publication Data

US 2020/0229667 A1 Jul. 23, 2020

(30) Foreign Application Priority Data

Jan. 21, 2019 (KR) ..... 10-2019-0007745

(51) Int. Cl.

| | |
|---|---|
| ***A47L 9/16*** | (2006.01) |
| ***A47L 9/04*** | (2006.01) |
| ***A47L 9/10*** | (2006.01) |
| ***A47L 9/28*** | (2006.01) |

(52) U.S. Cl.

CPC ..... *A47L 9/1683* (2013.01); *A47L 9/0477* (2013.01); *A47L 9/102* (2013.01); *A47L 9/106* (2013.01); *A47L 9/1633* (2013.01); *A47L 9/2842* (2013.01); *A47L 2201/024* (2013.01)

(58) Field of Classification Search

CPC ..... A47L 9/1683; A47L 9/0477; A47L 9/102; A47L 9/106; A47L 9/1633; A47L 9/2842; A47L 2201/024

See application file for complete search history.

(56) References Cited

U.S. PATENT DOCUMENTS

2006/0090428 A1 5/2006 Park et al.
2017/0273526 A1* 9/2017 Love ..... A47L 9/1608
(Continued)

FOREIGN PATENT DOCUMENTS

DE 20 2006 016366 U1 2/2007
JP 2005-323998 A 11/2005
JP 5197627 B2 5/2013
(Continued)

OTHER PUBLICATIONS

International Search Report dated May 19, 2020, issued in International Application No. PCT/KR2020/000880.
(Continued)

*Primary Examiner* — Andrew A Horton
(74) *Attorney, Agent, or Firm* — Jefferson IP Law, LLP

(57) ABSTRACT

A robot cleaner is provided. The robot cleaner includes a main body, a suction motor provided in the main body to generate a suction force, and a dust collector removably coupled to the main body to collect dust contained in air suctioned by the suction motor. The dust collector includes a first chamber to which the air, which is suctioned into the main body by the suction motor, is introduced, the first chamber including a filter to filter out dust in the suctioned air, and a second chamber arranged side by side with the first chamber, the second chamber including a connection port to which air, which is filtered b the filter in the first chamber, is introduced, and a cyclone dust separator to separate dust from the introduced air.

20 Claims, 15 Drawing Sheets

(56) References Cited

U.S. PATENT DOCUMENTS

| | | | |
|---|---|---|---|
| 2018/0177367 | A1 | 6/2018 | Amaral et al. |
| 2018/0296051 | A1 | 10/2018 | Jung et al. |

FOREIGN PATENT DOCUMENTS

| | | | |
|---|---|---|---|
| KR | 10-0854148 | B1 | 8/2008 |
| KR | 10-2014-0096610 | A | 8/2014 |
| KR | 10-2015-0143209 | A | 12/2015 |

OTHER PUBLICATIONS

Extended European Search Report dated Jan. 21, 2022, issued in European Patent Application No. 20745760.7.

* cited by examiner

ROBOT CLEANER

CROSS-REFERENCE TO RELATED APPLICATION(S)

This application is based on and claims priority under 35 U.S.C. § 119 of a Korean Patent Application number 10-2019-0007745, filed on Jan. 21, 2019, in the Korean Intellectual Property Office, the disclosure of which is incorporated by reference herein in its entirety.

BACKGROUND

1. Field

The disclosure relates to a robot cleaner. More particularly, the disclosure relates to a robot cleaner including an improved dust collecting chamber.

2. Description of Related Art

A robot cleaner is a home appliance that autonomously travels and cleans an arbitrary region without a user's manipulation. The robot cleaner includes a driving portion including wheels, a sensor identifying the surrounding environment, a fan generating a suction force, and a dust collector removing dust from air suctioned into a main body and the robot cleaner performs cleaning by sucking air from the floor while traveling on the floor.

In general, an inlet portion of the robot cleaner is formed on the bottom of the main body, and the inlet portion is provided with a rotating brush. The brush scatters dust and garbage on the floor with the rotation, and the dust and garbage are suctioned into the inside of the main body by the suction force of the fan. Accordingly, the robot cleaner includes a dust collector, and a filter included in the dust collector may be easily blocked by foreign substances such as dust. When the filter is blocked, the cleaning performance of the robot cleaner will be drastically deteriorated. Therefore, a user should perform maintenance such as replacing or cleaning the filter.

Other aspects, advantages, and salient features of the disclosure will become apparent to those skilled in the art from the following detailed description, which, taken in conjunction with the annexed drawings, discloses various embodiments of the disclosure.

Aspects of the disclosure are to address at least the above-mentioned problems and/or disadvantages and to provide at least the advantages described below Accordingly, an aspect of the disclosure is to provide a robot cleaner having an improved dust separation efficiency by including a dust collector including two different types of chambers.

Another aspect of the disclosure is to provide a robot cleaner including a structure capable of removing dust attached to a filter by itself in the robot cleaner.

Additional aspects will be set forth in part in the description which follows and, in part, will be apparent from the description, or may be learned by practice of the presented embodiments.

In accordance with an aspect of the disclosure, a robot cleaner is provided. The robot cleaner includes a main body, a suction motor to generate a suction force, the suction motor provided in the main body, and a dust collector to collect dust contained in air suctioned by the suction motor, the dust collector being removably coupled to the main body. The dust collector includes a first chamber to which the air, which is suctioned into the main body by the suction motor, is introduced, the first chamber including a filter to filter out dust in the suctioned air, and a second chamber arranged side by side with the first chamber, the second chamber including a connection port to which air, which is filtered by the filter in the first chamber, is introduced, and a cyclone dust separator to separate dust from the introduced air.

The first chamber may include an inlet to which the air of the main body is introduced, and the second chamber may include an outlet from which air, which is separated by the cyclone dust separator, is discharged, and the inlet and the outlet may be opened in a first direction to allow air to flow in and out of the first direction, and the connection port may be opened in a second direction to allow air to flow in the second direction corresponding to a direction with which the first chamber and the second chamber are arranged side by side.

The dust collector may include a box-shaped housing and a partition member to partition the inside of the housing so as to form the first chamber and the second chamber in the housing, and the inlet may be arranged on a first surface of the housing, the outlet may be arranged on a second surface opposite to the first surface, and the connection port may be arranged on the partition member.

The dust collector may include a housing cover provided to form an upper surface of the housing and removably coupled to the housing, and the first chamber and the second chamber may be opened to the outside when the housing cover is separated.

The filter may be rotatable.

The filter may include a body formed in a cylindrical shape, a filter hole formed on a surface of the body, and a connecting flow path formed in the filter to allow air, which is introduced into the filter through the filter hole, to flow into the connection port.

The dust collector may further include a dust remover to remove dust attached to the body by being in contact with at least a part of the body based on a rotation of the filter.

The dust remover may cover at least a part of an outer circumferential surface of the body.

The dust remover may cover approximately one quarter of the outer circumferential surface of the body along the outer circumferential of the body from the top of the outer circumferential surface of the body, and the dust remover may be arranged in a direction opposite to the inlet with respect to the body.

The dust remover may include a brush in contact with the body.

The robot cleaner may further include a filter driver to rotate the filter when the dust collector is coupled to the main body, and the dust collector may further include a transmission coupled to the filter driver to transmit a rotational force to the filter.

The transmission may include a first gear connected to the filter, and the filter driver may include a second gear engaged with the first gear when the dust collector is coupled to the main body.

The dust collector may further include a handle to transmit a rotational force, which is generated in the outside of the filter, to allow the filter to be rotated.

The body may extend in a direction corresponding to the first direction, and the filter may be rotated about a rotation axis extending in a direction corresponding to the first direction.

The dust collector discharges dust collected in the dust collector to the outside based on docking to a docking station, and the dust collector may include a discharge door to allow the dust collected in the second chamber to be discharged based on the docking to the docking station.

In accordance with another aspect of the disclosure, a robot cleaner is provided. The robot cleaner includes a main body, a suction motor to generate a suction force, the suction motor provided in the main body, and a dust collector to collect dust contained in air suctioned by the suction motor, the dust collector being removably coupled to the main body. The dust collector includes a first chamber to which the air, which is suctioned into the main body by the suction motor, is introduced, and the first chamber including a filter to filter out dust in the suctioned air, a second chamber in communication with the first chamber, the second chamber including a cyclone dust separator to separate dust from the air filtered by the filter, and a dust remover arranged in the first chamber and arranged to be in contact with the filter to remove dust attached to the filter.

The filter may be rotatable, and at least a part of the filter may come into contact with the dust remover by a rotation of the filter.

The dust collector may further include a connection port to allow air, which is filtered by the filter in the first chamber, to flow into the second chamber, and the filter may include a body formed in a cylindrical shape, a filter hole formed on a surface of the body, and a connecting flow path formed in the filter to allow the filtered air, which is introduced into the filter through the filter hole, to flow into the connection port The first chamber may include an inlet to which the air of the main body is introduced, and the second chamber may include an outlet from which air, which is separated by the cyclone dust separator, is discharged, and the inlet and the outlet may be opened in a first direction to allow air to flow in and out of the first direction, and the connection port may be opened in a second direction to allow air to flow in the second direction corresponding to a direction with which the first chamber and the second chamber are arranged side by side.

In accordance with another aspect of the disclosure, a robot cleaner is provided. The robot cleaner includes a main body, a suction motor to generate a suction force, the suction motor provided in the main body, and a dust collector removably coupled to the main body and configured to collect dust contained in air suctioned by the suction motor, the dust collector being removably coupled to the main body. The dust collector includes a first chamber, the first chamber including a filter to filter out dust contained in air suctioned by the suction motor and configured to be rotatable, a second chamber arranged side by side with the first chamber and in communication with the first chamber, and a dust remover is positioned in the first chamber and arranged to be in contact with the filter to remove dust attached to the filter based on a rotation of the filter. The second chamber includes a cyclone dust separator configured to additionally separate dust from the air filtered by the filter in the first chamber.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures

DETAILED DESCRIPTION

Figure 1:
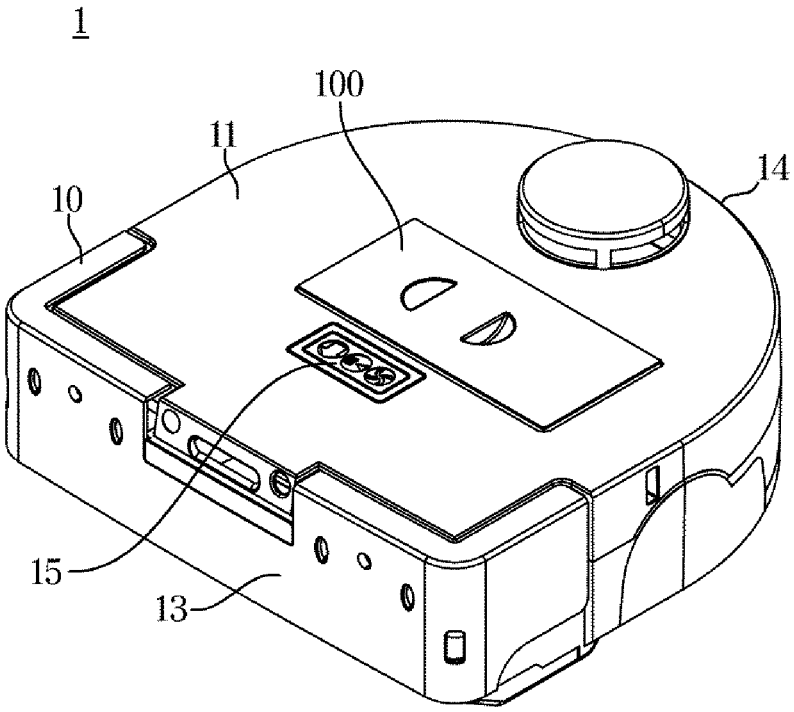
FIG. 1 is a perspective view illustrating a robot cleaner according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In addition, the same reference numerals or signs shown in the drawings of the disclosure indicate elements or components performing substantially the same function.

Also, the terms used herein are used to describe the embodiments and are not intended to limit and/or restrict the disclosure. In this disclosure, the terms "including", "having", and the like are used to specify features, numbers, operations, elements, components, or combinations thereof, but do not preclude the presence or addition of one or more of the features, elements, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "upper side", "lower side", and "front-rear direction" may be defined by the drawings, but the shape and the location of the component is not limited by the term.

Figure 2:
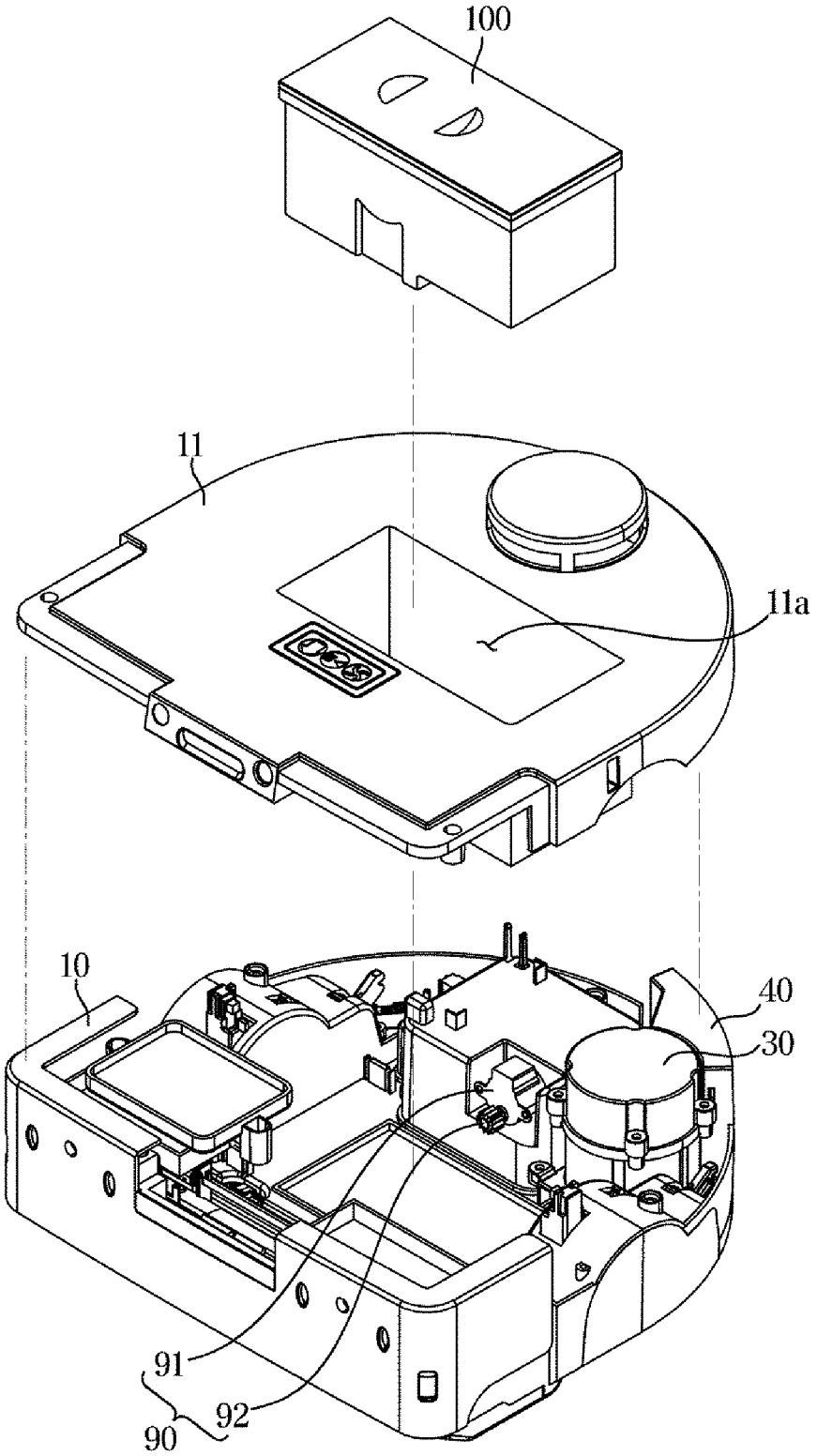
FIG. 2 is an exploded perspective view illustrating the robot cleaner according to an embodiment of the disclosure.
Figure 3:
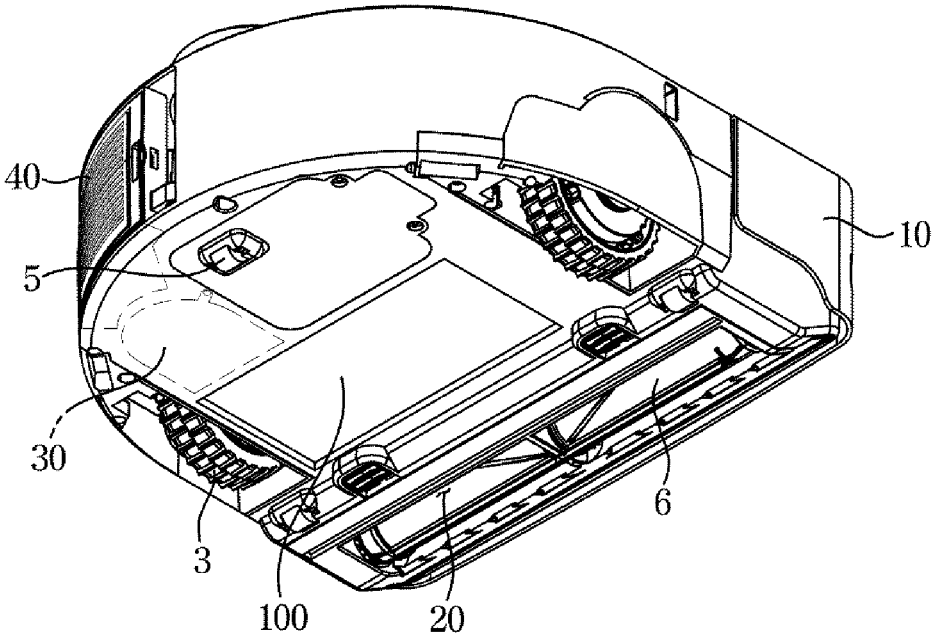
FIG. 3 is an exploded perspective view of a bottom surface of the robot cleaner of FIG. 1 according to an embodiment of the disclosure.
Figure 4:
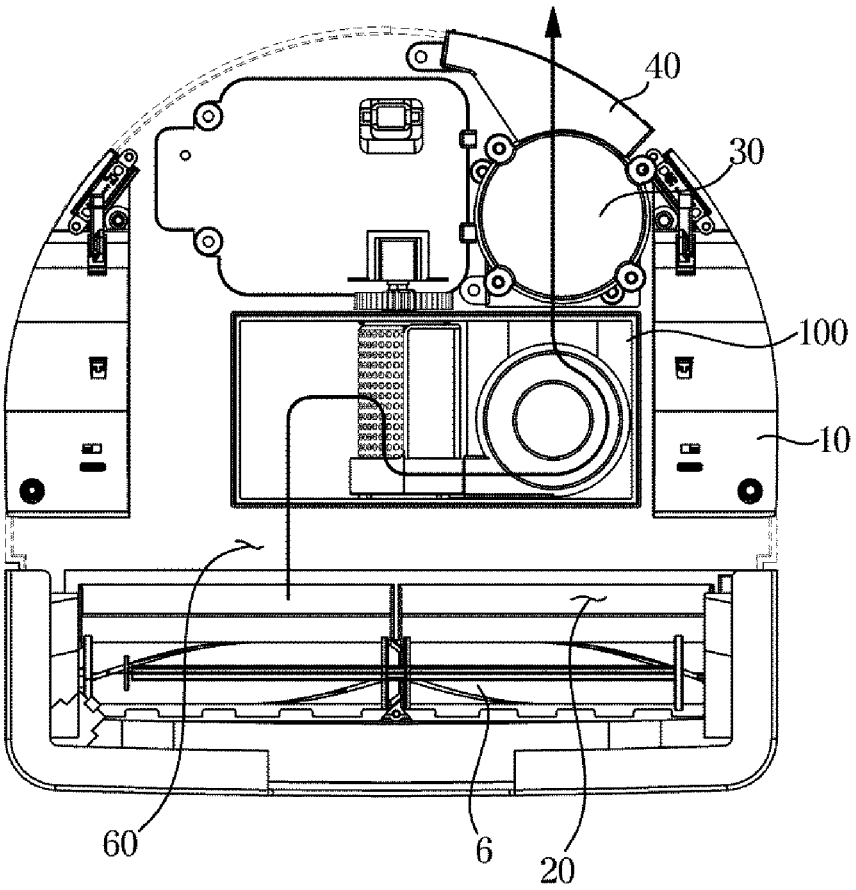
FIG. 4 is a view schematically illustrating some components of the robot cleaner of FIG. 1 according to an embodiment of the disclosure.

The disclosure will be described more fully hereinafter with reference to the accompanying drawings FIG. 1 is a perspective view illustrating a robot cleaner according to an embodiment of the disclosure, FIG. 2 is an exploded perspective view illustrating the robot cleaner according to an embodiment of the disclosure, FIG. 3 is an exploded perspective view of a bottom surface of the robot cleaner of FIG. 1 according to an embodiment of the disclosure, and FIG. 4 is a view schematically illustrating some components of the robot cleaner of FIG. 1 according to an embodiment of the disclosure.

Referring to FIGS. 1 to 4, a robot cleaner 1 may include a main body 10, a suction motor portion 30 arranged in the main body 10 and configured to generate a suction force, and a dust collector 100 configured to remove foreign substances such as dust from air that is suctioned into the inside of the main body 10.

The main body 10 may include a top cover 11 and a bottom cover 12 which form an appearance of the robot cleaner 1 and which are separable from each other.

That is, according to an embodiment, when the robot cleaner 1 is viewed from the top, a front surface 13 of the main body 10 has an approximately linear shape and a rear surface 14 has an approximately curved shape, but is not limited thereto. Alternatively, the front surface 13 and the rear surface 14 may be formed in an arc shape and thus when the robot cleaner 1 is viewed from the top, the robot cleaner 1 may have a circular shape as a whole.

The top cover 11 of the main body 10 may be provided with a sensor unit 15 configured to identify the surrounding environment for the autonomous traveling and configured to receive a signal from a remote controller (not shown).

A wheel 3 for traveling of the robot cleaner 1 and a caster 5 for assisting the wheel 3 to allow the main body 10 to stably travel may be provided on the bottom cover 12 of the main body 10. The wheel 3 may be provided in pairs left and right of the bottom cover 12 of the main body, and the caster 5 may be provided at the rear of the wheel 3. A wheel driver (not shown) for driving the wheel 3 may be provided inside the main body 10. The wheel driver (not shown) may include a drive motor configured to generate a rotational force and a gear assembly configured to transmit the rotational force of the motor to the wheel 3.

An inlet portion 20 may be formed on the bottom cover 12 of the main body 10 to suck dust from the floor of the indoor or outdoor into the main body 10. A brush 6 configured to scatter dust attached to the floor so as to allow the dust to be smoothly suctioned may be provided in the inlet portion 20. The brush 6 may be rotatable.

The dust collector 100 may be provided at the center of the main body 10. The dust collector 100 may be mounted to the main body 10 to be removably upward. Particularly, the dust collector 100 may be mounted to the main body 10 by passing through a seating groove 11*a* formed on the top cover 11.

The suction motor portion 30 may include a fan and a motor connected to the fan so as to generate a suction force. The fan and the motor may be arranged in the inside of the suction motor portion 30 behind the main body 10. The suction motor portion 30 may communicate with the dust collector 100 to be described later.

The robot cleaner 1 may include an intake flow path 60 configured to transmit a suction force of the suction motor portion 30 to the inlet portion 20 to suction air through the inlet portion 20 formed on the bottom cover 12 of the main body.

The intake flow path 60 may communicate with the inlet portion 20 and the dust collector 100.

In addition, as described above, the dust collector 100 may be connected to the suction motor portion 30, and the suction motor portion 30 may communicate with the outlet portion 40, which communicates with the outside, to discharge the suctioned air.

The outlet portion 40 may communicate with the suction motor portion 30 and may be arranged at the most rear of the main body 10. The outlet portion 40 may form at least a part of the rear surface 14 of the main body 10.

Accordingly, due to the suction force generated by the suction motor portion 30, external air containing dust may be introduced into the main body 10 along the inlet portion 20.

The introduced air may pass through the dust collector 100 along the intake flow path 60. At this time, in the dust collector 100, dust contained in the introduced air may be removed, and air from which the dust is removed may be discharged to the outside of the main body 10 by sequentially passing through the suction motor portion 30 and the outlet portion 40.

Hereinafter the dust collector 100 of the robot cleaner 1 according to an embodiment of the disclosure will be described in detail.

Figure 5:
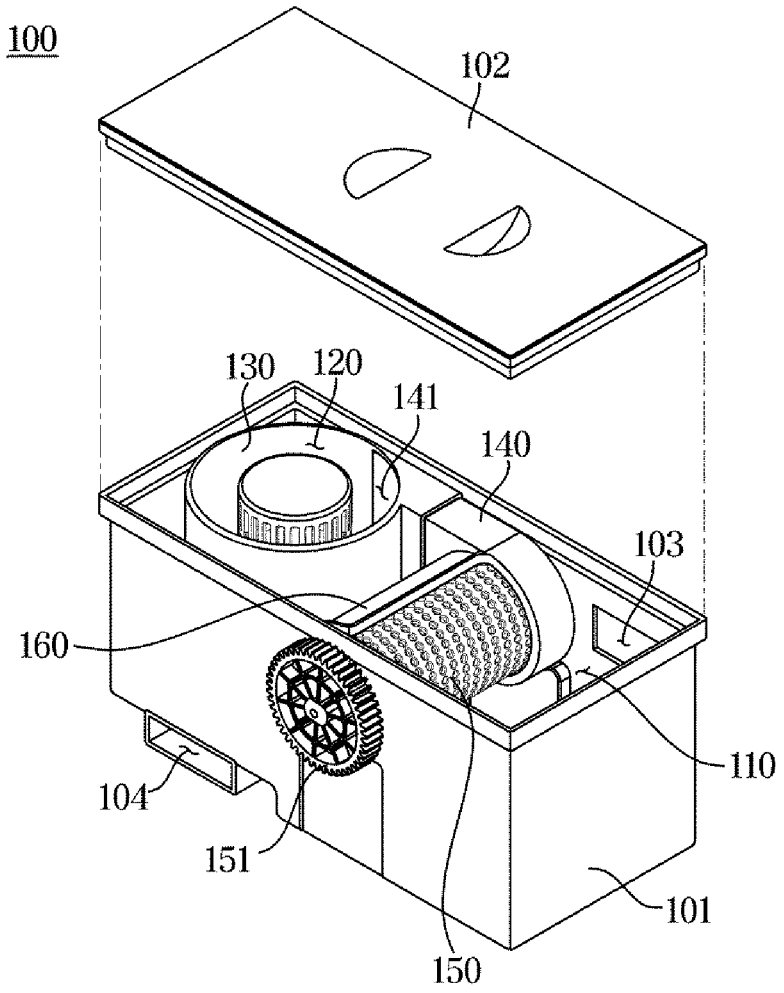
FIG. 5 is a perspective view illustrating a state in which a cover of a dust collector of the robot cleaner of FIG. 1 is opened according to an embodiment of the disclosure.
Figure 6:
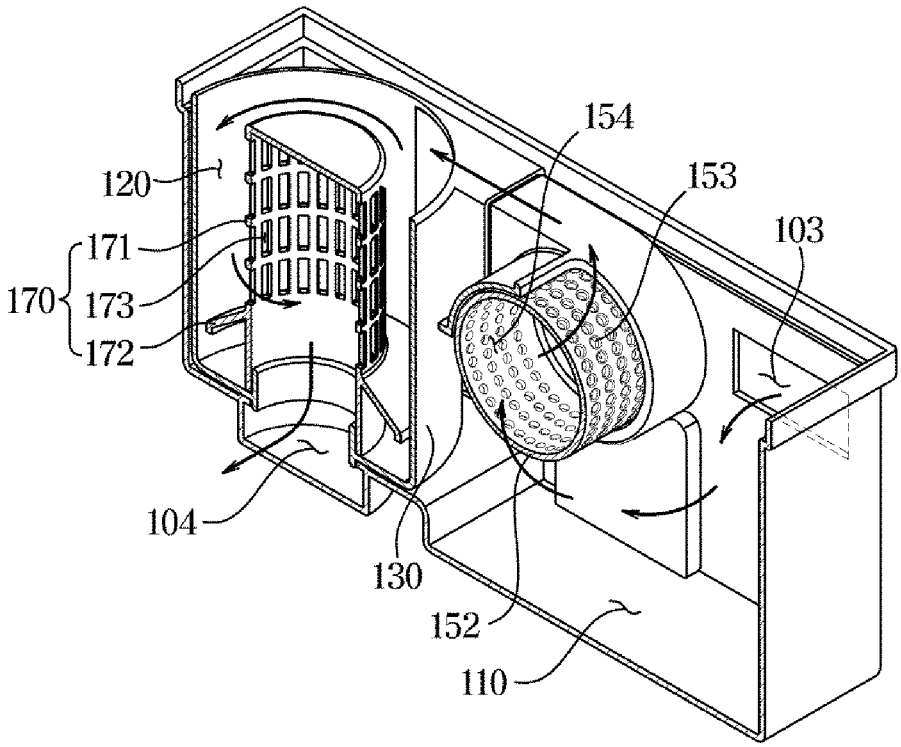
FIG. 6 is a view illustrating a state in which a part of a perspective view of the dust collector of FIG. 5 is cut out according to an embodiment of the disclosure.
Figure 7:
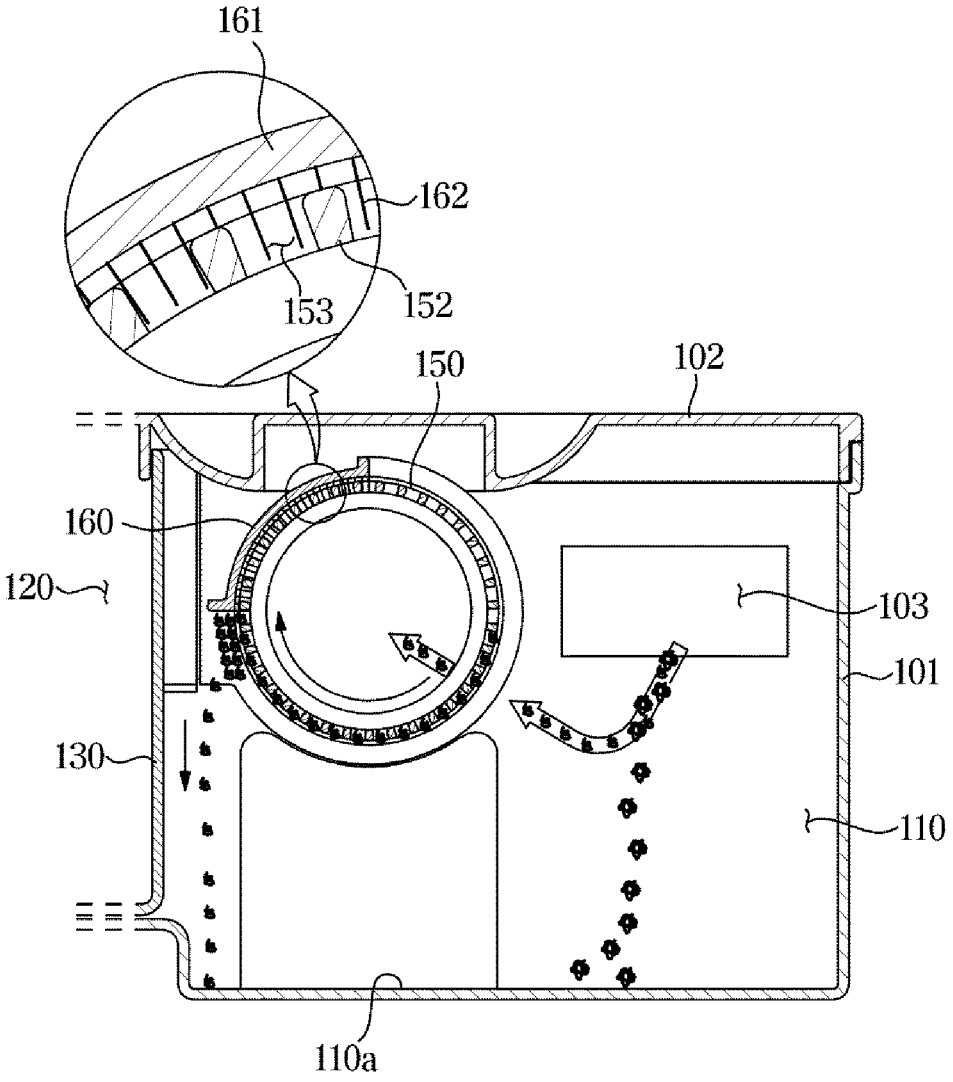
FIG. 7 is a view schematically illustrating a state in which the dust collector of FIG. 5 is driven according to an embodiment of the disclosure.

FIG. 5 is a perspective view illustrating a state in which a cover of a dust collector of the robot cleaner of FIG. 1 is opened according to an embodiment of the disclosure, FIG. 6 is a view illustrating a state in which a part of a perspective view of the dust collector of FIG. 5 is cut out according to an embodiment of the disclosure, and FIG. 7 is a view schematically it lustrating a state in which the dust collector of FIG. 5 is driven according to an embodiment of the disclosure.

A typical robot cleaner may be separated from a power supply and driven using only limited power. Therefore, it is difficult for the robot cleaner to be driven by a high power or high suction force like a general wire cleaner. Accordingly, the robot cleaner may be efficiently driven by the limited power generated from the battery.

In the robot cleaner of the related art, a filter is installed in a dust collecting chamber and air containing dust is passed through the filter, thereby collecting dust at a low flow rate. This method has a simple structure, but because there is no separate dust separator, the filter is easily blocked, and when the flow rate is increased to increase the cleaning efficiency, the filter is blocked faster, which causes the poor usability.

In addition, a cyclone separator may be used as another dust collection method. The cyclone separator has high dust separation efficiency, which leads to a long service life of the filter. However, because a robot cleaner using only a limited power is not able to obtain sufficient flow rate, a grill of the cyclone separator is easily blocked. The power consumption is greater than a method, in which air is passed through the filter, and thus it leads a difficulty of shortening a driving time of the robot cleaner.

Accordingly, the robot cleaner 1 according to an embodiment of the disclosure may include a dust collector 100 configured to improve a short service life of the filter and configured to prevent the cyclone separator, which is driven at a low flow rate, from being easily blocked.

Particularly, the dust collector 100 may include a housing 101 having an open upper surface and having a substantially rectangular parallelepiped shape, and a housing cover 102 configured to cover the upper surface of the housing 101.

The dust collector 100 includes an inlet 103 through which the dust collector 100 communicates with the intake flow path 60 so that the air of the intake flow path 60 flows into the dust collector 100.

The dust collector 100 includes an outlet 104 through which the dust collector 100 communicates with the suction motor portion 30 so that the air of the dust collector 100 is discharged to the suction motor portion 30.

The inlet 103 may be arranged on one surface of the housing 101 and the outlet 104 may be arranged on an opposite surface of the one surface of the housing 101.

Dust may be collected in an inner space of the housing 101. The inside of the housing 101 may be partitioned into a first chamber 110 and a second chamber 120 by a partition member 130.

With respect to the partition member 130, the outside of the partition member 130 may be defined as the first chamber 110 and the inside of the partition member 130 may be defined as the second chamber 120.

The first chamber 110 and the second chamber 120 may be an independent space that is partitioned, but may communicate with each other through a connection port 141.

The partition member 130 is provided in a cylindrical shape and may form a cylindrical housing of a cyclone separator to be described later.

However, the partition member 130 is not limited to the disclosure, and thus the partition member 130 may be formed as an additional component other than the housing of the cyclone separator. For example, the partition member 130 may be provided as a component such as a wall configured to partition the inside of the housing 101. One side of the wall may be partitioned as the first chamber 110, and the other side of the wall may be partitioned as the second chamber 120.

The first chamber 110 may be in direct communication with the inlet 103, and the second chamber 120 may be in direct communication with the outlet 104. In addition, the first chamber 110 and the second chamber 120 may be connected through the connection port 141.

The inlet 103 and the outlet 104 may be opened toward approximately the same direction. Accordingly, air, which is introduced into and discharged from the dust collector 100, may flow in the same direction, respectively.

In addition, the connection port 141 may be opened in a direction substantially perpendicular to a direction in which the inlet 103 and the outlet 104 are opened.

Accordingly, the air, which is introduced into th first chamber 110 along the direction, in which the inlet 103 is opened, may flow to the second chamber 120 along a direction perpendicular to the direction, in which the inlet 103 is opened, and then the air may be discharged from the second chamber 120 along a direction perpendicular to the direction in which the connection port 141 is opened.

That is, a direction, in which air flows in the dust collector 100, may be switched a plurality of times while sequentially passing through the first chamber 110 and the second chamber 120.

The housing cover 102 may cover the opened upper surface of the housing 101 as mentioned above, and when the housing cover 102 is separated from the housing 101, the first chamber 110 and second chamber 120 may be opened to the outside.

Therefore, when a user manually removes the dust collected in the dust collector 100, the user can simultaneously remove the dust collected in the first chamber 110 and the second chamber 120 through the separation of the housing cover 102.

A filter 150 configured to filter air, which is introduced through the inlet 130 and has dust, may be installed in the inside of the first chamber 110.

The filter 150 may include a body 152 having a cylindrical shape and a plurality of filter holes 153 formed on the surface of the body 152.

The body 152 may be provided in the cylindrical shape and provided to extend in the direction in which the inlet 103 is opened.

Particularly, the filter 150 is arranged on one surface of the housing 101, on which the inlet 103 is arranged, to be apart from the inlet 103, and the body 152 may extend in the direction in which the inlet 103 is opened.

Accordingly, the air introduced through the inlet 103 may not be directly collide with the filter 150, but collide with the filter 150 while flowing in the first chamber 110.

This is because, when the filter 150 is disposed to face the direction in which the inlet 103 is opened, dust in the air is directly attached to the body 152 and thus the amount of dust or foreign substances attached to the filter 150 is increased.

The body 152 may include a connecting flow path 154 configured to al low air, which is introduced to the inside of the filter 150 through the plurality of filter holes 153, to be connected to a connecting portion 140 including the connection port 141.

That is, large size dust in the air introduced into the first chamber 110 may collide with the surface of the body 152 and fall down to the first chamber 110, thereby being collected on a bottom surface 110*a* of the first chamber 110.

The large size dust represents dust or foreign substances having a diameter greater than a diameter of the filter hole 153 of the filter 150, and thus the large size dust may collide with the surface of the body 153 and fall down to the bottom surface 110*a* of the first chamber 110 because the large size dust does not pass through the filter hole 153. Accordingly, the first chamber 110 may primarily collect dust or foreign substances through the filter 150.

The air, which is passed through the filter 150 with the small size dust, may be moved into the second chamber 120 communicating with the connection port 141 through the connecting portion 140.

The second chamber 120 is an inner space of the cyclone separator. As described above, the partition member 130 may serve as a cylindrical housing of the cyclone separator while partitioning the space into the first chamber 110 and the second chamber 120.

A cyclone filter 170 may be provided in the second chamber 120. The cyclone filter 170 may include a cylindrical portion 171 formed in the partition member 130 and having a size smaller than a size of the cylindrical shape of the partition member 130, a collector 172 extending radially outward of the cylindrical portion 171 from a lower end of the cylindrical portion 171 and configured to collect dust or foreign substances upon the vortex of air, and a plurality of through holes 173 arranged on an outer circumferential surface of the cylindrical portion 171 and configured to communicate with the inside of the cyclone filter 170 to allow air to pass through the cyclone filter 170.

The inside of the cyclone filter 170 may communicate with the outlet 104. Accordingly, air passing through the cyclone filter 170 may be discharged to the outside of the dust collector 100 through the outlet 104.

Air, which is introduced into the inside of the second chamber 120 via the connecting portion 140 and the connection port 141, may be moved along an inner circumferential surface of the cylindrical partition member 130 and then swirled between the inner circumferential surface of the partition member 130 and the outer circumferential surface of the cyclone filter 170.

In the process of the vortex of air, dust may be separated from the air by the centrifugal force, and the separated dust may fall and be seated in the collector 172. Thereafter, the dust, from which the air is removed, may be introduced into the inside of the cyclone filter 170 through the through hole 173 and then discharged to the outside of the dust collector 100 through the outlet 104.

As described above, when the cyclone separator is included in the robot cleaner 1, the dust in the air flowing in the cyclone separator is not separated due to the low flow rate and but introduced into the cyclone filter 170. Accordingly, the dust may cover the through hole 173 arranged on the cylindrical portion 171 and thus the drive thereof may be stopped.

However, as for the dust collector 100 according to an embodiment of the disclosure, the large size dust may be primarily removed in the first chamber 110 before the air is introduced into the second chamber 120 forming the cyclone separator. Therefore, it is relatively easy to separate the air from dust or foreign substances in the second chamber 120, and thus it is possible to continuously drive the robot cleaner 1 at the low flow rate without covering the through hole 173 with the foreign substance or dust.

Therefore, the dust collector 100 of the robot cleaner 1 which generates a low flow rate may also efficiently collect dust or foreign substances through the cyclone separator.

As described above, the air containing dust may be introduced into the dust collector 100 and the dust may be removed as the air sequentially passes through the first chamber 110 and the second chamber 120. At this time, when the dust in the air passing through the filter 150 in the first chamber 110 is attached to the body 152 of the filter 150 without falling down to the bottom surface of the first chamber 110, the air flow may be limited and thus the robot cleaner 1 may not be driven.

Accordingly, it is inconvenient for a user because the user should periodically remove the dust attached to the body 152 of the filter 150. However, the dust collector 100 according to an embodiment of the disclosure may include a dust remover 160 configured to automatically remove dust attached to the body 152 of the filter 150.

The dust remover 160 may be arranged to cover at least a part of the outer circumferential surface of the body 152. It is appropriate that the dust remover 160 is arranged to cover approximately one quarter of the outer circumferential surface of the body 152 along the outer surface of the body 152 from the top of the outer circumferential surface of the body 152.

This is to prevent dust or foreign substances from being caught between the upper side of the filter 150 and the housing cover 102, which may occur when a distance between the upper side of the filter 150 and the housing cover 102 is small.

However, the disclosure is not limited thereto, and the dust remover 160 may be arranged to cover an area of one quarter or less of the surface of the outer circumferential surface of the body 152. The shape of the dust remover 160 may vary according to the output of the flow rate generated by the suction motor portion 30.

The dust remover 160 may include a frame 161 covering at least a part of the body 152 and a brush 162 arranged in the frame 161.

The frame 161 may be arranged spaced apart from the body 152 by a predetermined distance. The frame 161 may be formed as a curved surface having a direction corresponding to a circumferential direction of the body 152, and may extend in a direction corresponding to the direction in which the body 152 extends.

However, the disclosure is not limited thereto, and the frame 161 may not include a curved surface but may have a bar shape extending in a direction corresponding to a direction in which the body 152 extends The brush 162 may be arranged to maintain in contact with the body 152. That is, the brush 162 may be formed longer than the predetermined distance between the frame 161 and the body 152.

At least a part of the brush 162 may penetrate the inside of the filter hole 153. Therefore, foreign substances or dust attached around the filter hole 153 may be removed by the brush 162.

However, the disclosure is not limited thereto, and the dust remover 160 may not include the brush 162 and may have a shape in which the frame 161 is in a direct contact with the outer circumferential surface of the body 152. Accordingly, the frame 161 may directly remove the dust or foreign substances attached to the outer circumferential surface of the body 152. In this case, the frame 161 may be formed of a material including ductility such as rubber.

The filter 150 may be rotatably installed in the first chamber 110. The filter 150 may be rotated about a rotation axis extending in a direction corresponding to the extending direction of the body 152.

That is, the filter 150 may be provided to be rotatable in one direction or the other direction about a rotation axis extending in a direction corresponding to the direction in which the inlet 103 is opened.

On the outer side of the housing 101, a transmission 151 coupled to the filter 150 in the rotation axis of the filter 150 so as to transmit the rotational force to the filter 150 may be provided. The transmission 151 may be provided in the shape of a gear.

The transmission 151 may be coupled to the body 152 by passing through the housing 101. Although not shown in the drawing, the transmission 151 may he coupled to the body 152 by passing through the housing 101 using a shaft, and an additional sealing member may be disposed between the shaft and the housing 101.

The transmission 151 may transmit the rotational force generated by a filter driver 90, which is arranged in the inside of the main body 10, to the filter 150 to rotate the filter 150 (refer to FIG. 2).

The filter driver 90 may include a drive motor 91 and a gear 92 connected to the drive motor 91. The gear 92 may be engaged with the transmission 151 when the dust collector 100 is coupled to the main body 10.

Because the dust collector 100 is removable from the main body as mentioned above, the transmission 151 and the gear 152 may be also removable from to each other. Therefore, the transmission 151 may be coupled to the dust collector 100 and the gear 92 may be coupled to the main body 10.

The dust collector 100 may be provided to be coupled to the main body 10 in a vertical direction, and thus the transmission 151 and the gear 92 may also be provided to be in contact with each other in the vertical direction. Although the transmission 151 is not engaged with the gear 92 when the dust collector 100 is mounted to the main body 10, the transmission 151 may be rotated and then engaged with the gear 92.

The filter 150 may be rotated by the transmission 151. Accordingly, the entire outer circumferential surface of the body 152 may be in contact with the dust remover 160 so as to remove and fall dust or foreign substances attached to the outer circumferential surface of the body 152.

Particularly, because the brush 162 of the dust remover 160 is always in contact with any part of the outer circumferential surface of the body 152, the entire outer circumferential surface of the body 152 may be in contact with the brush 162 upon the rotation of the body 152, thereby removing dust attached to the body 152.

Because the filter driver 90 is driven based on the drive of the robot cleaner 1, the filter 150 may be periodically rotated based on the suction force. Therefore, the dust attached to the filter 150 may be periodically removed based on the drive of the robot cleaner 1 and thus the filter 150 may be not blocked.

Therefore, it is possible to ease a difficulty that the air flow is limited due to the block of the filter 150 arranged in the dust collector 100 and the robot cleaner 1 is not driven. Further, in the first chamber 110, the dust may be collected by the filter 150 and in the second chamber 120, the dust may be collected by the cyclone separator. Accordingly, the dust may be collected twice and thus it is possible to effectively collect the dust or foreign substances.

The robot cleaner of the related art may use one of the filter or the cyclone separator. Accordingly, when using the filter, the structure may be relatively simple, the flow rate may be increased, and the dust may be relatively easily discharged. However, the filter may be relatively easily blocked.

When using the cyclone separator, the filter may be maintained for a long time, but the power consumption is increased to obtain a certain level of separation efficiency, which may be inefficient in a robot cleaner that requires the use of a limited battery power. It is difficult to discharge the dust due to the complicated internal structure. Further, although it may be possible to use both of the filter and the cyclone separator as illustrated in an embodiment, it is still difficult to effectively drive the robot cleaner due to the dust attached to the filter.

However, in order to ease the difficulty, as for the dust collector 100 according to an embodiment of the disclosure, the first chamber 110 may include the filter 150 and the dust remover 160 configured to automatically remove the dust attached to the filter 150, and the second chamber 120 may be provided in such a way that only the air passing through the filter 150 is introduced and the introduced air is separated into the dust and the air by the cyclone separator.

Accordingly, the dust collector 100 formed inside the robot cleaner 1 may efficiently collect dust and foreign substances, thereby increasing the efficiency of the robot cleaner 1.

Hereinafter a robot cleaner 1 according to another embodiment of the disclosure will be described. A configuration other than a handle 155 of a dust collector 100 to be described later is the same as the configuration of the robot cleaner 1 according to an embodiment of the disclosure described above and thus a description thereof will be omitted.

Figure 8:
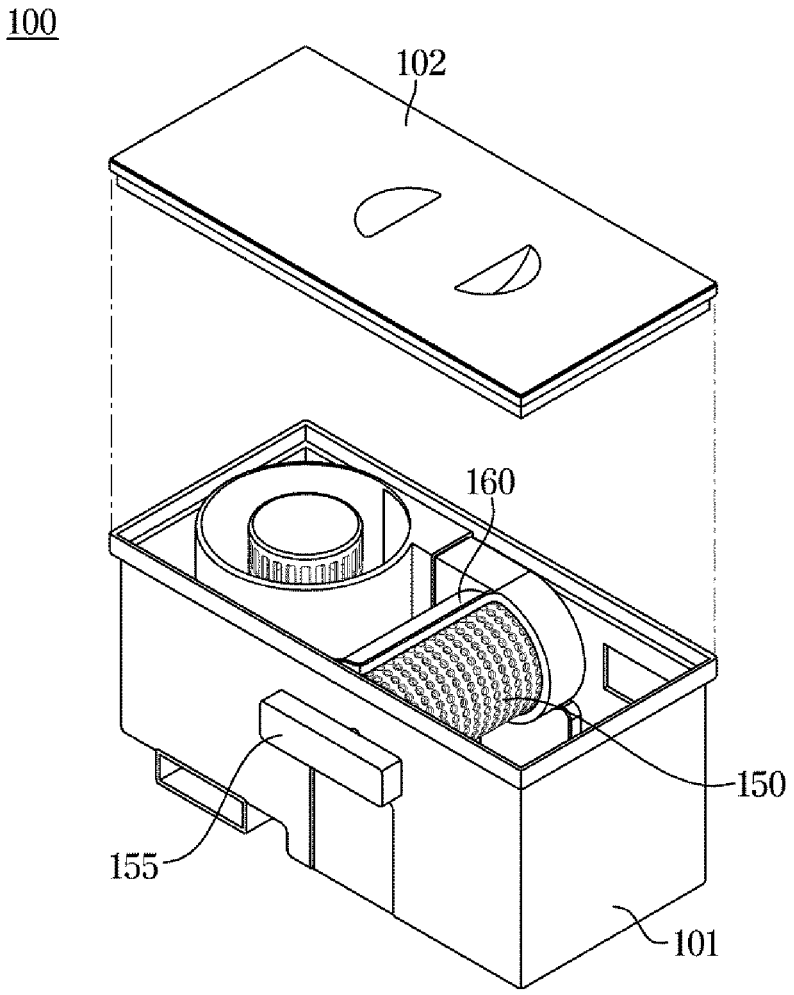
FIG. 8 is a perspective view illustrating a dust collector of a robot cleaner according to an embodiment of the disclosure.

FIG. 8 is a perspective view illustrating a dust collector of a robot cleaner according to an embodiment of the disclosure.

The dust collector 100 may include the handle 155 configured to rotate a filter 150.

As described above, the dust collector 100 may be removably provided in the main body 10. A user may rotate the handle 155 to remove the dust attached to the body 152 while separating the dust collector 100 from the main body.

That is, the filter 150 arranged in the dust collector 100 of the robot cleaner 1 according to an embodiment of the disclosure described above may he automatically rotated by the filter driver 90, but the filter 150 of the dust collector 100 according to another embodiment of the disclosure may be taken out of the main body 10 and then rotated by the pressure of the handle 155 by a user.

Hereinafter a robot cleaner 1 according to still another embodiment of the disclosure will be described. A configuration other than a docking station 500 to be described later is the same as the configuration of the robot cleaner 1 according to an embodiment of the disclosure described above and thus a description thereof will be omitted.

Figure 9:
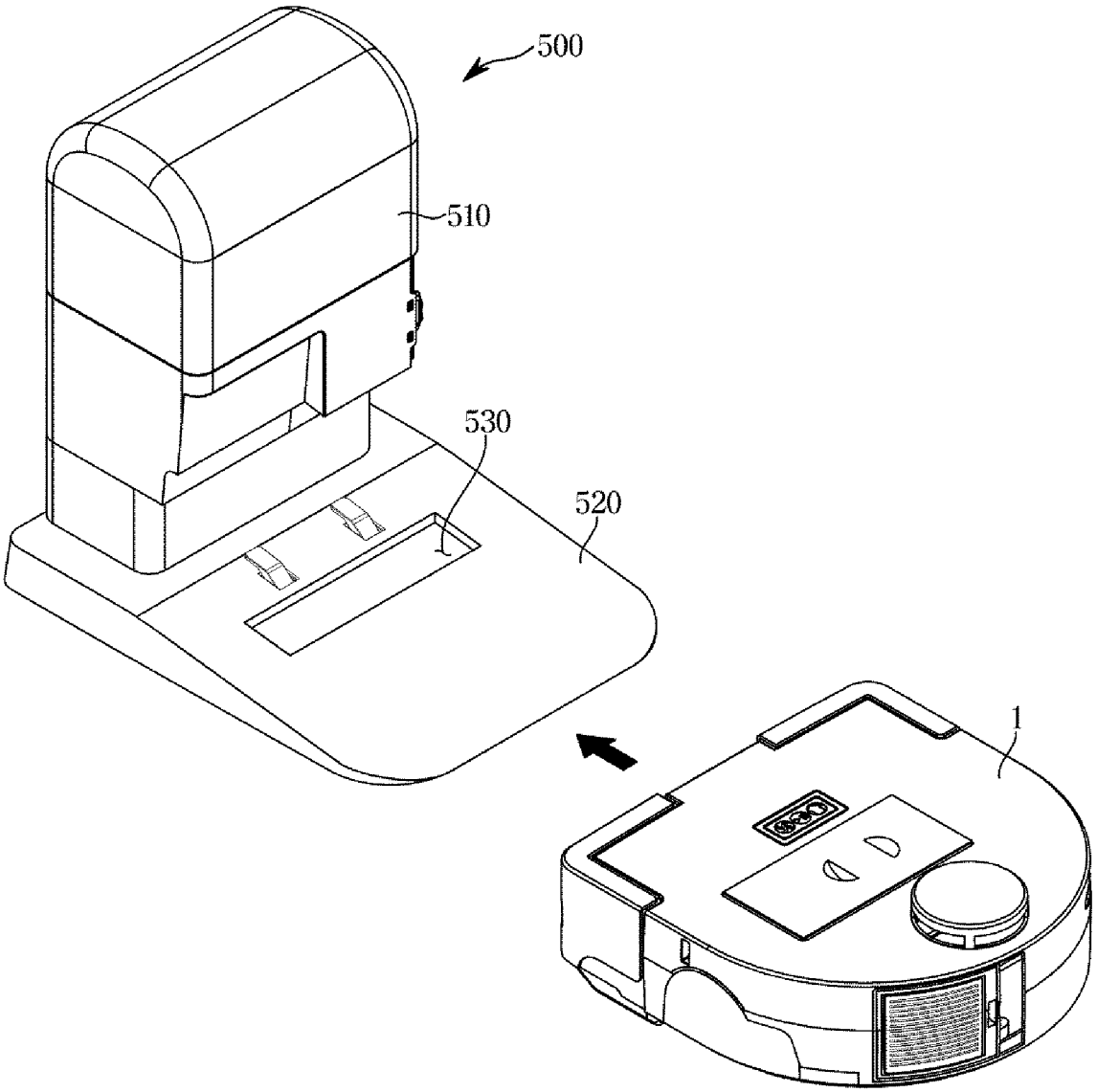
FIG. 9 is a view illustrating the robot cleaner and a docking station according to an embodiment of the disclosure.
Figure 10:
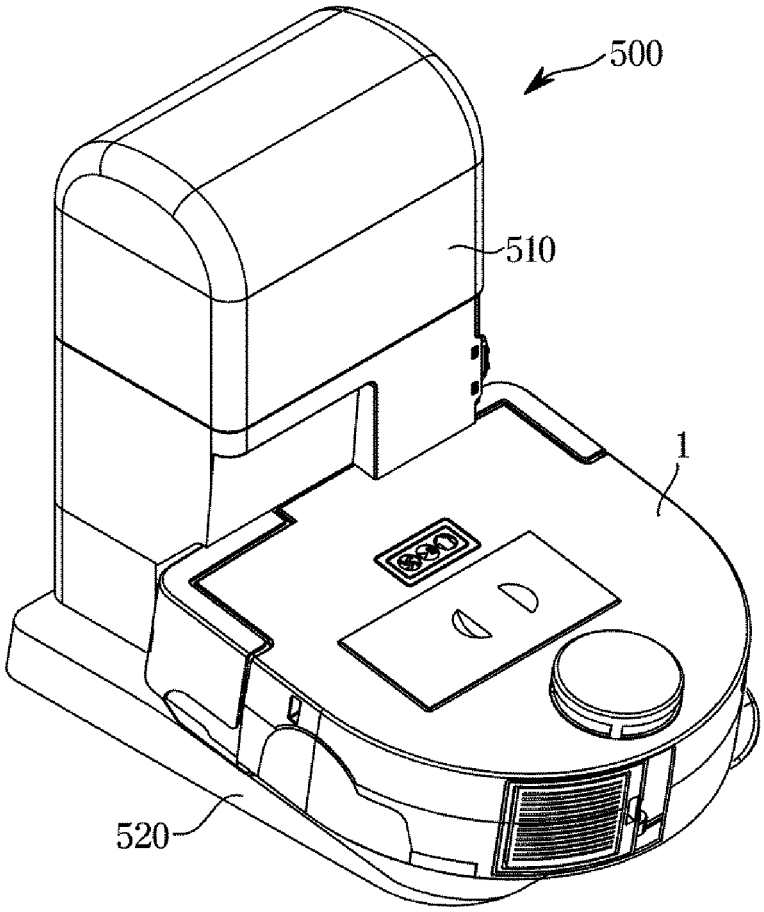
FIG. 10 is a view illustrating a state in which the robot cleaner is docked to the docking station according to an embodiment of the disclosure.

FIG. 9 is a view illustrating the robot cleaner and a docking station according to an embodiment of the disclosure, and FIG. 10 is a view illustrating a state in which the robot cleaner is docked to the docking station according to an embodiment of the disclosure.

The robot cleaner 1 may clean the floor while traveling along the floor. The docking station 500 may charge the robot cleaner 1 when the robot cleaner 1 needs to be charged during cleaning or after cleaning. Further, the docking station 500 may automatically remove foreign substances or dust in the dust collector 100 when the inside of the dust collector 100 is fully filled with dirt and thus needs to discharge the dirt.

The docking station 500 may be configured to hold the robot cleaner 1. The docking station 500 may include a main body 510 configured to provide power to the robot cleaner 1 and a seating portion 520 on which the robot cleaner 1 is seated.

When the robot cleaner 1 is seated, the docking station 500 may charge the battery of the robot cleaner 1 or collect the collected dirt in the dust collector 100 of the robot cleaner 1.

The seating portion 520 may include an automatic suction portion 530 configured to suck foreign substances and dust, which are collected in the dust collector 100, through the inlet portion 20 of the robot cleaner 1.

The automatic suction portion 530 may be arranged at a position corresponding to the inlet portion 20 of the robot cleaner 1 when the robot cleaner 1 is seated on the seating portion 520 (D). The automatic suction portion 530 may communicate with a fan motor (not shown), which is configured to generate a suction force, to suck external air through the automatic suction portion 530.

Therefore, when the robot cleaner 1 is seated and a dust removal operation of the docking station 500 is started, the fan motor (not shown) may be driven to generate an intake air flow in the automatic suction portion 530, and the intake air flow may be transmitted to the inlet portion 20 of the robot cleaner 1.

As mentioned above, as for the dust collector 100, the inlet portion 20 may communicate with the intake flow path 60. Accordingly, when the automatic suction portion 530 generates the suction force on the inlet portion 20 side, the intake air flow may be transmitted to the dust collector 100 through the inlet portion 20 and the intake flow path 60. Foreign substances and dust collected in the dust collector 100 may be discharged to the outside of the robot cleaner 1 through the intake flow path 60 and the inlet portion 20 along the intake air flow, and thus the collected foreign substances and dust may be moved to the automatic suction portion 530.

Hereinafter a robot cleaner 1 according to still another embodiment of the disclosure will be described. A configuration other than a docking station 500 and a dust collector 200 to be described later is the same as the configuration of the robot cleaner 1 according to an embodiment of the disclosure described above and thus a description thereof will be omitted.

Figure 11:
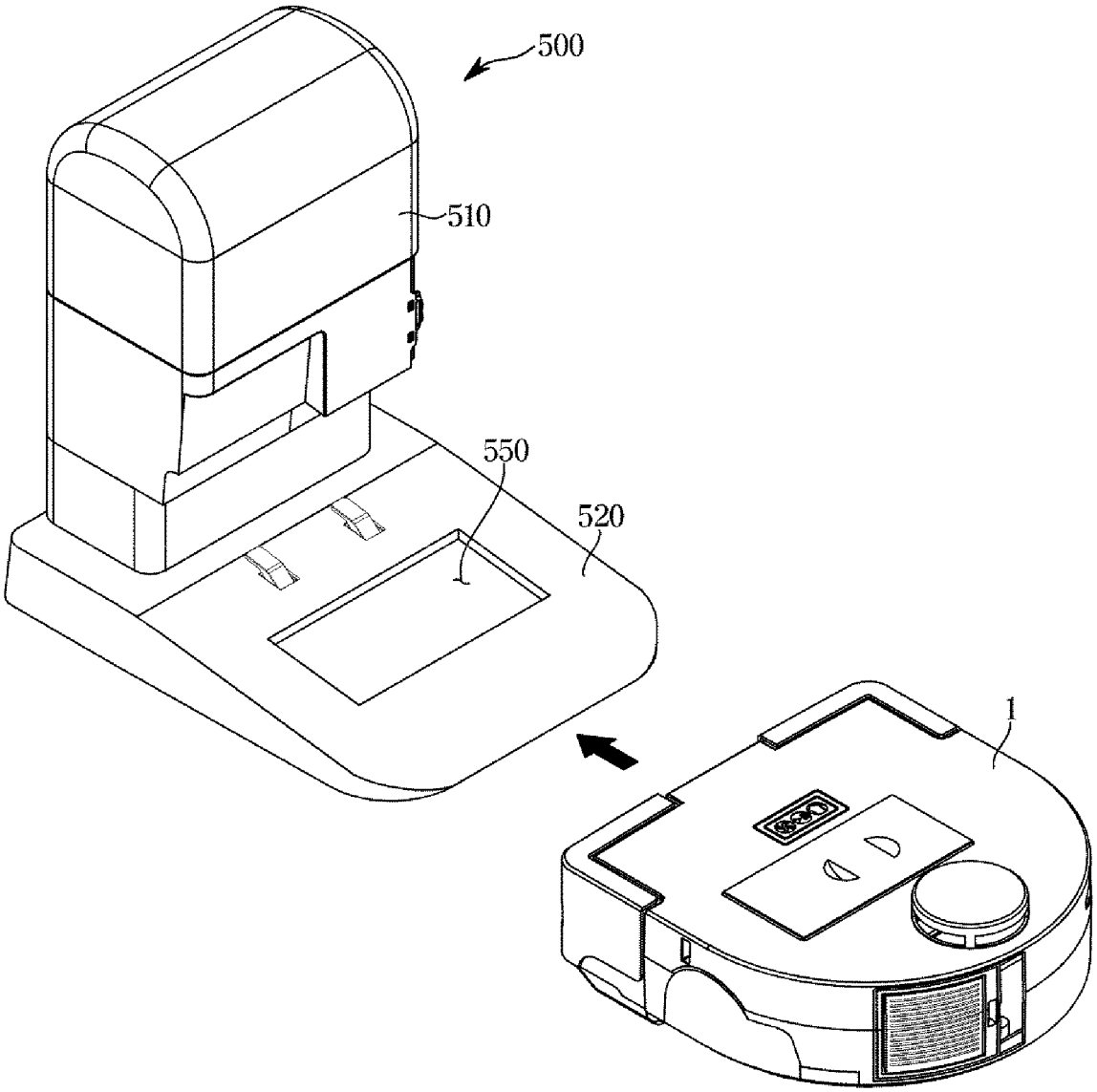
FIG. 11 is a view illustrating a robot cleaner and a docking station according to an embodiment of the disclosure.
Figure 12:
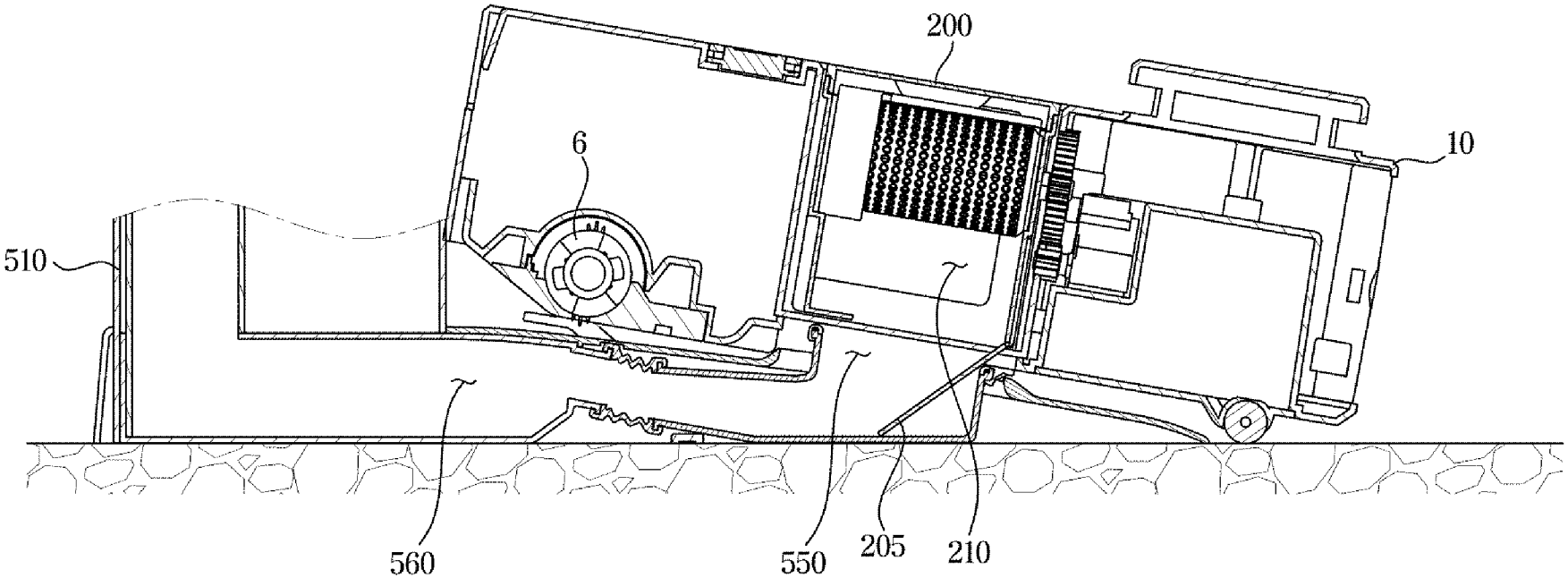
FIG. 12 is a schematic cross-sectional view illustrating a state in which the robot cleaner is docked to the docking station according to an embodiment of the disclosure.
Figure 13:
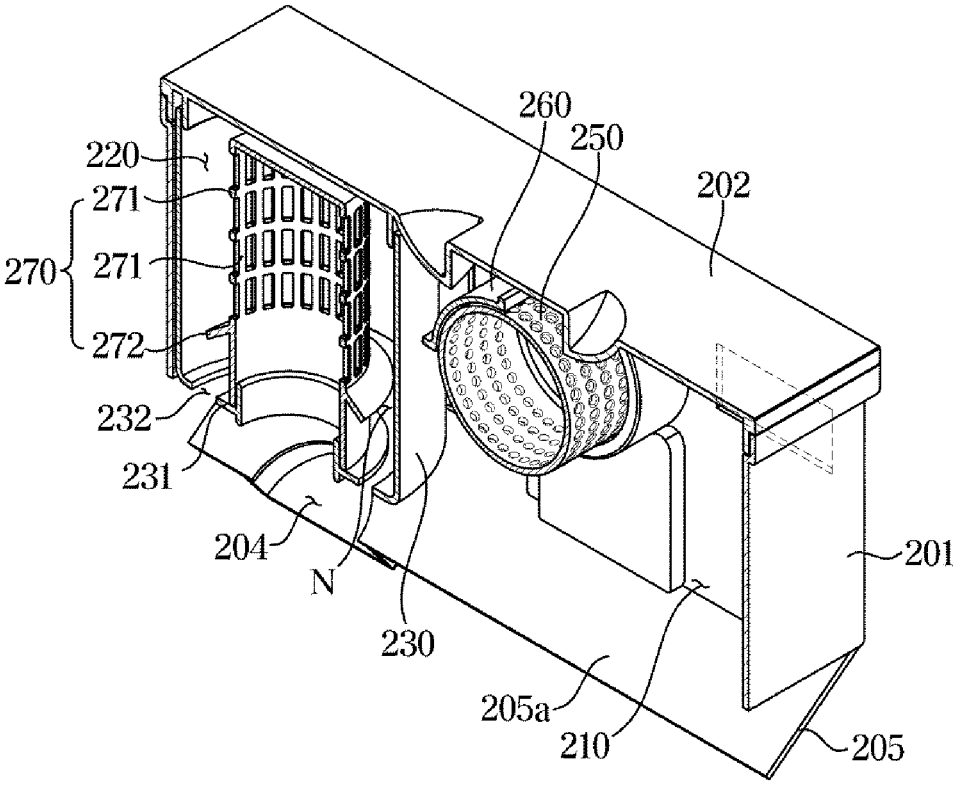
FIG. 13 is a perspective view of a dust collector of a robot cleaner according to an embodiment of the disclosure.

FIG. 11 is a view illustrating a robot cleaner and a docking station according to an embodiment of the disclosure, FIG. 12 is a schematic cross-sectional view illustrating a state in which the robot cleaner is docked to the docking station according to an embodiment of the disclosure, and FIG. 13 is a perspective view of a dust collector of a robot cleaner according to an embodiment of the disclosure.

The seating portion 520 of the docking station 500 may include an automatic suction portion 550 configured to communicate with the dust collector 200 of the robot cleaner 1 and configured to suck foreign substances and dust collected in the dust collector 200

The automatic suction portion 550 may be arranged at a position corresponding to a lower end of the dust collector 200 of the robot cleaner 1 when the robot cleaner 1 is seated on the seating portion 520.

The automatic suction portion 550 may communicate with a fan motor (not shown), which is provided in the main body 510 to generate a suction force, through a flow path 560 disposed in the seating potion 520.

When the robot cleaner 1 is seated and the dust removal operation of the docking station 500 is started, a discharge door 205 of the dust collector 200 may be opened, and the fan motor (not shown) may be driven. Accordingly, dust and foreign substances collected in the dust collector 200 may be introduced into the automatic suction portion 550.

When the dust removal operation of the docking station 500 is started, the docking station 500 may transmit an electrical signal to the robot cleaner 1 to open the discharge door 205 of the dust collector 200 through a controller (not shown) of the robot cleaner 1, which is not shown in the drawing.

Alternatively, when the robot cleaner 1 is seated, a physical external force may be applied to the dust collector 200 by a door opening device (not shown) disposed adjacent to the automatic suction portion 550 and thus the discharge door 205 may be opened, which is not shown in the drawing.

The discharge door 205 may form a lower surface of the dust collector 200, particularly, a lower surface of a housing 201 and the discharge door 205 may be hinged to the housing 201.

Because the discharge door 205 forms the entire lower surface of the housing 201, when the discharge door 205 is opened, both the lower portion of the first chamber 210 and the second chamber 220 may be opened and thus it is possible to efficiently discharge the dirt collected in the dust collector 200.

In the second chamber 220, foreign substances or dust may be collected in a collector 272. A portion of the second chamber 220, which is opened when the discharge door 205 is opened, may correspond to an inner region of a cylindrical portion 271 of a cyclone filter 270, and thus practically, the collector 272 may not be opened to the outside.

Accordingly, even when the discharge door 205 is opened, it may be difficult to discharge foreign substances or dust collected in the collector 272 to the outside.

Accordingly, a cutout portion 232 may be provided on a lower end of a partition member 230, and the cutout portion 232 may be formed in such a way that at least a part of the lower end of the partition member 230 is cut out, so as to communicate with the outside upon the open of the discharge door 205.

Dust and foreign substances collected in the collector 272 may be discharged to the outside through the cutout portion 232 when the discharge door 205 is opened.

In addition, the collector 272 is provided to extend radially outward of the cylindrical portion 271. In order to easily move the dust and foreign substances collected in the collector 272 to the cutout portion 232, a predetermined distance N may be provided between an end portion of the collector 272 in the radial direction of the cylindrical portion 271, and the inner circumferential surface of the partition member 230.

The cutout portion 232 may come into contact with an upper surface 205*a* of the discharge door 205 when the discharge door 205 is closed. Therefore, when the discharge door 205 is closed, the partition member 230 of the second chamber 220 may not communicate with the outside except for an outlet 204. Therefore, in the second chamber 220, the air and the dust may be separated from each other normally through the cyclone separation operation.

Hereinafter a robot cleaner 1 according to still another embodiment of the disclosure will be described. A configuration other than a dust collector 300 to be described later is the same as the configuration of the robot cleaner 1 according to an embodiment of the disclosure described above and thus a description thereof will be omitted.

Figure 14:
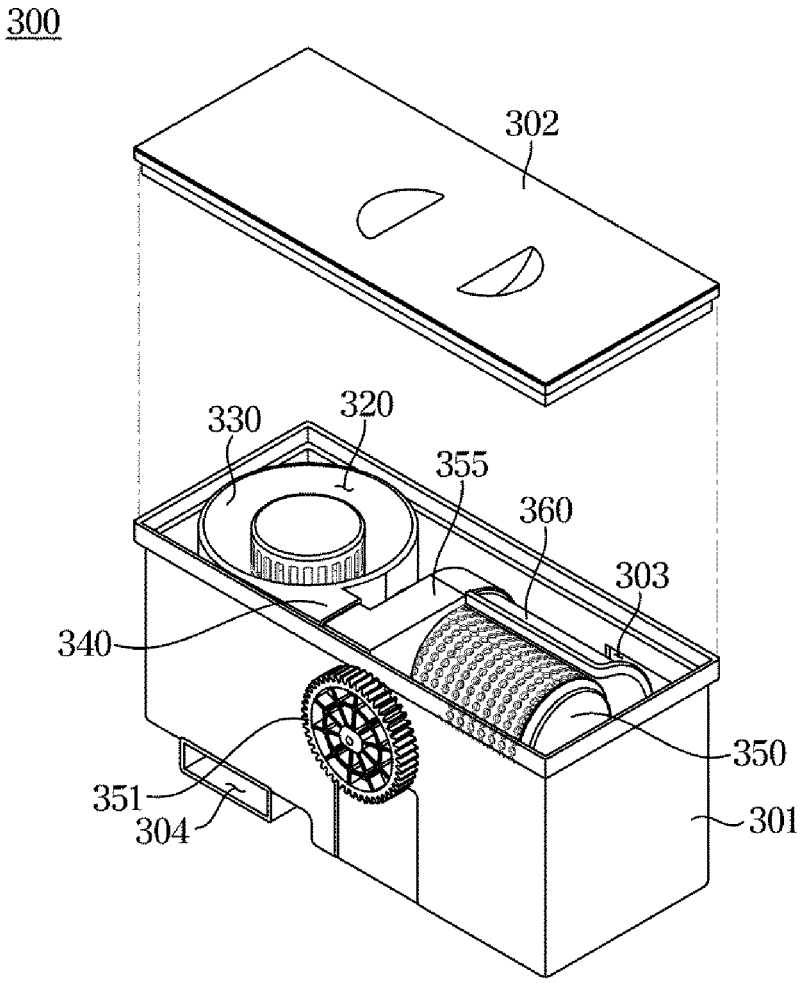
FIG. 14 is a perspective view of a dust collector of a robot cleaner according to an embodiment of the disclosure.

FIG. 14 is a perspective view of a dust collector of a robot cleaner according to an embodiment of the disclosure.

A filter 350 of the dust collector 300 may extend in a direction perpendicular to a direction in which an inlet 303 is opened. In addition, a rotation axis of the filter 350 may also extend in the direction perpendicular to the direction in which the inlet 303 is opened.

As for the dust collector 100 according to an embodiment of the disclosure, the filter 150 may extend in the direction corresponding to the direction in which the inlet 103 is opened, but is not limited thereto. Therefore, directions in which the filter 350 extends and the filter 350 is arranged may vary as illustrated in FIG. 14.

Because the filter 350 extends in the direction corresponding to a longitudinal direction of a housing 301, a width of the housing 301 may be small. Therefore, the dust collector 300 may be formed in various sizes.

A dust remover 360 may be arranged between the filter 350 and the inlet 303. This is to prevent the air, which introduced from the inlet 303, from directly colliding with the filter 350.

The air, which introduced from the inlet 303, may collide with the dust remover 360 and flow in the housing 301 and then collide with the filter 350. While flowing in the housing 301, large size or heavy weight dust or foreign substances may be separated before colliding with the filter 350, and thus the collection efficiency may be increased.

The filter 350 may include a switch 355 configured to switch a direction of the rotational force transmitted from a transmission 351. This is because, as the transmission 351 and the rotation axis of the filter 350 are perpendicular to each other unlike an embodiment of the disclosure described above, the rotational force transmitted from the transmission 351 is required to be switched to the perpendicular direction.

Although not shown in the drawing, a plurality of gears, worm gears, and cams may be provided in the switch 355 and thus the switch 355 may switch the direction of the rotational force to be perpendicular.

The air passing through the filter 350 may be introduced into the second chamber 320 through a connecting portion 340, and thus a secondary separation may be performed.

Hereinafter a robot cleaner 1 according to still another embodiment of the disclosure will be described. A configuration other than a dust collector 400 to be described later is the same as the configuration of the robot cleaner 1 according to an embodiment of the disclosure described above and thus a description thereof will be omitted.

The dust collectors 100, 200, and 300 according to an embodiment or other embodiments of the disclosure described above are provided such that the first chamber and the second chamber are arranged side by side in the left and right or front and rear directions.

Figure 15:
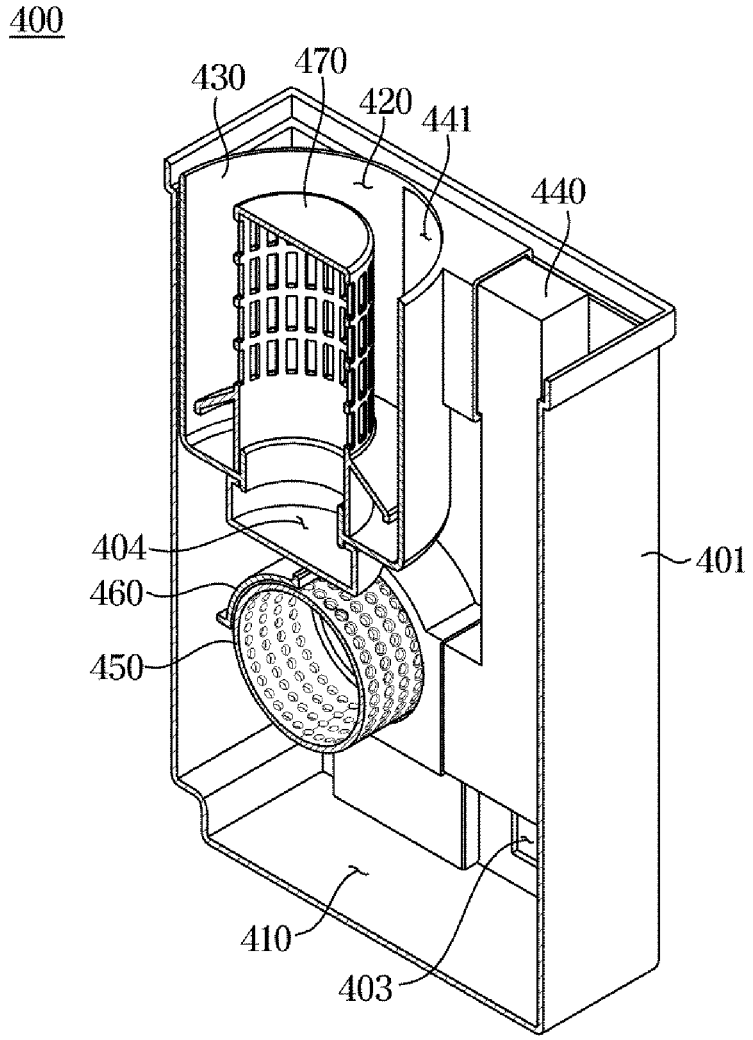
FIG. 15 is a perspective view of a dust collector of a robot cleaner according to an embodiment of the disclosure.

However, the disclosure is not limited thereto, and as illustrated in FIG. 15, in the dust collector 400 according to still another embodiment, a first chamber 410 and a second chamber 420 may be arranged in the vertical direction.

FIG. 15 is a perspective view of a dust collector of a robot cleaner according to an embodiment of the disclosure.

A housing 401 of the dust collector 400 may extend such that a longitudinal direction of the housing 401 aligns with the vertical direction. This is because a second chamber 420 is disposed above a filter 450.

The filter 450 may be disposed below the housing 401 and a partition member 430 may be disposed above the filter 450. Accordingly, the first chamber 410 including the filter 450 may form a lower portion of the housing 401 and the second chamber 420 formed in the partition member 430 may form an upper portion of the housing 401.

A connecting portion 440 configured to connect the first chamber 410 to the second chamber 420 may extend in the vertical direction.

An inlet 403 communicating with the first chamber 410 may be disposed in the lower portion of the housing 401, and an outlet 404 communicating with the second chamber 420 may be disposed in the substantially upper portion of the housing 401.

Because a volume of the dust collector 400 may be narrow in the front, rear, left and right directions, the dust collector 400 may be easily mounted on the robot cleaner 1 that is narrowly formed in the front, rear, left and right directions.

As is apparent from the above description, the dust collector of the robot cleaner includes the first chamber configured to collect dust by using the filter and the second chamber configured to collect dust by using the cyclone dust separator. The filter provided in the first chamber includes a component configured to remove dust attached to the filter in the robot cleaner. Therefore, it is possible to improve the cleaning efficiency.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A robot cleaner comprising:

a main body;

a suction motor to generate a suction force, the suction motor provided in the main body; and a dust collector to collect dust contained in air suctioned by the suction motor, the dust collector being removably coupled to the main body;

wherein the dust collector comprises:

a first chamber to which the air, which is suctioned into the main body by the suction motor, is introduced, the first chamber comprising a filter to filter out dust in the suctioned air, and a second chamber arranged side by side with the first chamber, the second chamber comprising:

a connection port to which air, which is filtered by the filter in the first chamber, is introduced, and a cyclone dust separator to separate dust from the introduced air.

2. The robot cleaner of claim 1, wherein the first chamber comprises an inlet to which the air of the main body is introduced, wherein the second chamber comprises an outlet from which air, which is separated by the cyclone dust separator, is discharged, wherein the inlet and the outlet are opened in a first direction to allow air to flow in and out of the first direction, and wherein the connection port is opened in a second direction to allow air to flow in the second direction corresponding to a direction with which the first chamber and the second chamber are arranged side by side.

3. The robot cleaner of claim 2, wherein the dust collector comprises a box-shaped housing and a partition member configured to partition the inside of the housing so as to form the first chamber and the second chamber in the housing.

wherein the inlet is arranged on a first surface of the housing, wherein the outlet is arranged on a second surface opposite to the first surface, and wherein the connection port is arranged on the partition member.

4. The robot cleaner of claim 3, wherein the dust collector comprises a housing cover provided to form an upper surface of the housing and removably coupled to the housing, and wherein the first chamber and the second chamber are opened to the outside when the housing cover is separated.

5. The robot cleaner of claim 2, wherein the filter is rotatable.

6. The robot cleaner of claim 5, wherein the filter comprises a body formed in a cylindrical shape, a filter hole formed on a surface of the body, and a connecting flow path formed in the filter to allow air, which is introduced into the filter through the filter hole, to flow into the connection port.

7. The robot cleaner of claim 6, wherein the dust collector further comprises a dust remover configured to remove dust attached to the body by being in contact with at least a part of the body based on a rotation of the filter.

8. The robot cleaner of claim 7, wherein the dust remover covers at least a part of an outer circumferential surface of the body.

9. The robot cleaner of claim 8, wherein the dust remover covers approximately one quarter of the outer circumferential surface of the body along the outer circumferential of the body from the top of the outer circumferential surface of the body, and wherein the dust remover is arranged in a direction opposite to the inlet with respect to the body.

10. The robot cleaner of claim 7, wherein the dust remover comprises a brush in contact with the body.

11. The robot cleaner of claim 6, wherein the body extends in a direction corresponding to the first direction, and wherein the filter is rotated about a rotation axis extending in an axial direction corresponding to the first direction.

12. The robot cleaner of claim 5, further comprising:

a filter driver configured to rotate the filter when the dust collector is coupled to the main body, wherein the dust collector further comprises a transmission coupled to the filter driver to transmit a rotational force to the filter.

13. The robot cleaner of claim 12, wherein the transmission comprises a first gear connected to the filter, and wherein the filter driver comprises a second gear engaged with the first gear when the dust collector is coupled to the main body.

14. The robot cleaner of claim 5, wherein the dust collector further comprises a handle configured to transmit a rotational force, which is generated in the outside of the filter, to allow the filter to be rotated.

15. The robot cleaner of claim 14, wherein the dust collector discharges dust collected in the dust collector to the outside based on docking to a docking station, and wherein the dust collector comprises a discharge door configured to allow the dust collected in the second chamber to be discharged based on the docking to the docking station.

16. A robot cleaner comprising:

a main body;

a suction motor to generate a suction force, the suction motor provided in the main body; and a dust collector to collect dust contained in air suctioned by the suction motor, the dust collector being removably coupled to the main body;

wherein the dust collector comprises:

a first chamber to which the air, which is suctioned into the main body by the suction motor, is introduced, the first chamber comprising a filter to filter out dust in the suctioned air, a second chamber in communication with the first chamber, the second chamber comprising a cyclone dust separator to separate dust from the air filtered by the filter, and a dust remover arranged in the first chamber and arranged to be in contact with the filter to remove dust attached to the filter.

17. The robot cleaner of claim 16, wherein the filter is rotatable, and wherein at least a part of the filter comes into contact with the dust remover by a rotation of the filter.

18. The robot cleaner of claim 17, wherein the dust collector further comprises a connection port to allow air, which is filtered by the filter in the first chamber, to flow into the second chamber, and wherein the filter comprises a body formed in a cylindrical shape, a filter hole formed on a surface of the body, and a connecting flow path formed in the filter to allow the filtered air, which is introduced into the filter through the filter hole, to flow into the connection port.

19. The robot cleaner of claim 18, wherein the first chamber comprises an inlet to which the air of the main body is introduced, wherein the second chamber comprises an outlet from which air, which is separated by the cyclone dust separator, is discharged, wherein the inlet and the outlet are opened in a first direction to allow air to flow in and out of the first direction, and wherein the connection port is opened in a second direction to allow air to flow in the second direction corresponding to a direction with which the first chamber and the second chamber are arranged side by side.

20. A robot cleaner comprising:

a main body;

a suction motor to generate a suction force, the suction motor provided in the main body; and a dust collector removably coupled to the main body and configured to collect dust contained in air suctioned by the suction motor, the dust collector being removably coupled to the main body, wherein the dust collector comprises:

a first chamber, the first chamber comprising a filter to filter out dust contained in air suctioned by the suction motor and configured to be rotatable, a second chamber arranged side by side with the first chamber and in communication with the first chamber, and a dust remover is positioned in the first chamber and arranged to be in contact with the filter to remove dust attached to the filter based on a rotation of the filter, and wherein the second chamber comprises a cyclone dust separator configured to additionally separate dust from the air filtered by the filter in the first chamber.

* * * * *